US006077819A

United States Patent [19]

Mahler et al.

[11] Patent Number: 6,077,819

[45] Date of Patent: Jun. 20, 2000

[54] AZEOTROPES OF CHLOROFLUOROETHANES OF THE FORMULA $CF_3CCl_{2+X}F_{1-X}$ WITH HF AND MANUFACTURING PROCESSES THEREWITH

[75] Inventors: Barry A. Mahler, Glen Mills, Pa.; Ralph N. Miller, Newark; V. N. Mallikarjuna Rao, Wilmington, both of Del.

[73] Assignee: E. I. du Pont de Nemours and Company, Wilmington, Del.

[21] Appl. No.: 08/146,862

[22] Filed: Nov. 1, 1993

[51] Int. Cl.[7] ..... C11D 3/18; C11D 3/43

[52] U.S. Cl. ..... 510/412; 510/407; 510/415; 570/161; 570/164; 570/170

[58] Field of Search ..... 252/172, DIG. 9; 203/67; 570/161, 164, 170; 510/401, 412, 413

[56] References Cited

U.S. PATENT DOCUMENTS

| | | | |
|---|---|---|---|
| 2,478,362 | 8/1949 | Benning | 202/51 |
| 3,490,739 | 1/1970 | Buckman et al. | 252/60 |
| 3,947,558 | 3/1976 | van Eijl | 203/80 |
| 4,738,732 | 4/1988 | Anderson et al. | 148/23 |
| 4,745,236 | 5/1988 | Azerad et al. | 570/166 |
| 5,055,624 | 10/1991 | Lantz et al. | 570/167 |
| 5,155,082 | 10/1992 | Tung et al. | 502/228 |
| 5,196,616 | 3/1993 | Lee et al. | 570/178 |
| 5,211,817 | 5/1993 | Adams et al. | 203/82 |

FOREIGN PATENT DOCUMENTS

| | | | |
|---|---|---|---|
| 832501 | 1/1970 | Canada . | |
| 317981 | 5/1989 | European Pat. Off. . | |
| 0 317 981 | 5/1989 | European Pat. Off. | C07C 19/08 |
| 0 354 697 | 2/1990 | European Pat. Off. | C07C 19/08 |
| 0 509 449 | 10/1992 | European Pat. Off. | C07C 19/08 |
| WO 93/17988 | 9/1993 | WIPO | C07C 17/38 |
| WO 95/12566 | 5/1995 | WIPO | C07C 19/12 |

OTHER PUBLICATIONS

Marangoni et al, *J. Fluorine Chem.* vol. 19 pp. 21–34 1981.

Gervasutti, C. et al, *J. Fluorine Chem.*, 19, 1–20, 1981–82.

Bitner, J. L. et al, U.S Dept. Comm. Off. Tech. Serv. Rep. 136732, 25, 1958.

Schotte, W., *Ind. Eng. Chem. Process Des. Dev.*, 19, 432–439, 1980.

Martin, G. Q., *Hydrocarbon Processing*, 241–246, Nov. 1975.

*Primary Examiner*—Kery Fries

[57] ABSTRACT

A process is disclosed for recovering HF from a product mixture comprising HF and at least one compound having the formula $CF_3CCl_{2+x}F_{1-x}$ (where x is 0 or 1). The process includes the steps of distilling the product mixture to remove all products which have a lower boiling point than the lowest boiling azeotrope containing HF and said at least one compound; and distilling said azeotrope to recover HF as an azeotropic composition containing HF and said at least one compound. Also disclosed are azeotrope and azeotrope-like compositions which consist essentially of hydrogen fluoride in combination with from about 10 to 27 mole percent $CCl_3CF_3$ or from about 35 to 56 mole percent $CCl_2FCF_3$.

6 Claims, No Drawings

AZEOTROPES OF CHLOROFLUOROETHANES OF THE FORMULA $CF_3CCl_{2+x}F_{1-x}$ WITH HF AND MANUFACTURING PROCESSES THEREWITH

FIELD OF THE INVENTION

This invention relates to azeotropic compositions of hydrogen fluoride with halogenated hydrocarbons and their use in manufacturing processes, and more particularly to azeotropes of perhalogenated ethanes with HF and use thereof.

BACKGROUND 1,1-Dichlorotetrafluoroethane (i.e., $CF_3CCl_2F$ or CFC-114a) is of interest as an intermediate to 1,1,1,2-tetrafluoroethane (i.e., $CF_3CH_2F$ or HFC-134a) which can be obtained via catalytic hydrogenolysis of its carbon-chlorine bonds using a supported metal hydrogenation catalyst (see e.g., C. Gervasutti et al., J. Fluorine Chem., 1981/82, 19, pgs. 1–20). HFC-134a is an environmentally acceptable potential replacement for chlorofluorocarbon (i.e., CFC) refrigerants, blowing agents, aerosol propellants and sterilants that are being viewed with concern in connection with the destruction of stratospheric ozone. It is highly desired that the 1,1-dichlorotetrafluoroethane employed in the hydrogenolysis route to HFC-134a has as low a content of 1,2-dichlorotetrafluoroethane (i.e., $CF_2ClCF_2Cl$ or CFC-114) as practicable since the presence of CFC-114 during hydrogenolysis can lead to formation of 1,1,2,2-tetrafluoroethane (i.e., $CHF_2CHF_2$ or HFC-134; see e.g., J. L. Bitner et al., U.S. Dep. Comm. Off. Tech. Serv. Rep. 136732, (1958), p. 25). HFC-134 mixed in HFC-134a may be objectionable for some applications depending on concentration and, since the two isomers boil only 7° C. apart, separation of the isomers in high purity is difficult.

$CF_3CCl_2F$ can be obtained by reacting $CCl_3CF_3$ (i.e., 1,1,1-trichlorotrifluoroethane or CFC-113a) with HF using various catalysts. Normally, excess HF is used to achieve relatively favorable reactor rates. In vapor-phase processes, typical reactor products contain HCl, unreacted $CF_3CCl_3$ and HF as well as $CF_3CCl_2F$. In liquid-phase processes the reactor products contain predominately HCl, $CF_3CCl_2F$ and HF as well as traces of $CF_3CCl_3$. HF may be removed from the halogenated hydrocarbon components of the product mixture using conventional aqueous solution scrubbing techniques. However, the production of substantial amounts of scrubbing discharge can create aqueous waste disposal concerns.

There remains a need for processes utilizing HF in such product mixtures as well as halogenated hydrocarbons therein such as CFC-113a and CFC-114a. Both $CF_3CCl_2F$ and $CCl_3CF_3$ (like their isomers) can be fluorinated by catalytic reaction with HF to form $CF_3CF_3$ (i.e., perfluoroethane or PFC-116) a useful etchant compound (see e.g., PCT Patent Publication No. WO 93/17988).

SUMMARY OF THE INVENTION

The present invention provides a process for recovering HF from a product mixture comprising HF and at least one compound having the formula $CF_3CCl_{2+x}F_{1-x}$ (where x is 0 or 1). The process comprises (1) distilling the product mixture to remove all products which have a lower boiling point than the lowest boiling azeotrope containing HF and said at least one compound; and (2) distilling said azeotrope to recover HF as an azeotropic composition containing HF and said at least one compound.

Also provided are compositions which consist essentially of hydrogen fluoride in combination with an effective amount of a compound selected from the group consisting of $CCl_3CF_3$ and $CCl_2FCF_3$ to form an azeotrope or azeotrope-like composition with hydrogen fluoride, said composition containing from about 10 to 27 mole percent $CCl_3CF_3$ or from about 35 to 56 mole percent $CCl_2FCF_3$.

DETAILED DESCRIPTION

The process of this invention involves azeotropic distillation of HF with at least one compound selected from the group consisting of $CF_3CCl_3$ and $CF_3CCl_2F$. The product mixtures distilled in accordance with this invention can be obtained from a variety of sources. These sources include product mixtures produced by hydrofluorination of $CCl_3CF_3$. Product mixtures may also be provided by adding CFC-113a and/or CFC-114a to HF-containing compositions.

In accordance with this invention, the product mixture is distilled to remove all products which have a lower boiling point than the lowest boiling azeotrope containing HF and $CF_3CCl_2F$ and/or $CF_3CCl_3$. Such low-boiling materials can include, for example, HCl, and low boiling halogenated hydrocarbons such as $CClF_2CF_3$ and $CF_3CF_3$. For continuous processes, distillate and azeotropes with higher boiling points can be advantageously removed from appropriate sections of the distillation column.

In accordance with this invention, the lowest boiling azeotrope containing HF and $CF_3CCl_2F$ and/or $CF_3CCl_3$ is then distilled such that HF is recovered as an azeotropic composition containing HF together with $CF_3CCl_2F$ and/or $CF_3CCl_3$. For example, where the mixture (after distilling components boiling at lower temperatures than the lowest boiling azeotrope of HF with $CF_3CCl_2F$ and/or $CF_3CCl_3$) consists essentially of HF and $CF_3CCl_2F$, HF may be recovered as an azeotrope consisting essentially of $CF_3CCl_2F$ and HF. If excess amounts of $CF_3CCl_2F$ or HF remain after azeotropes are recovered from these mixtures, such excess may be recovered as a relatively pure compound. Where the mixture (after distilling components boiling at lower temperatures than the lowest boiling azeotrope of HF with $CF_3CCl_2F$ and/or $CF_3CCl_3$) consists essentially of HF and $CF_3CCl_3$ (e.g., no $CF_3CCl_2F$ is present), HF may be recovered as an azeotrope consisting essentially of $CF_3CCl_3$ and HF. If excess amounts of $CF_3CCl_3$ or HF remain after azeotropes are recovered from these mixtures, such excess may be recovered as a relatively pure compound. The distillation of azeotropes containing HF and $CF_3CCl_2F$ and/or $CF_3CCl_3$ typically may be done at a wide variety of temperatures and pressures. Typically the temperature is between about −25° C. and 150° C. (e.g., from 20° C. to 125° C.) and the pressure is between 50 kPa and 4750 kPa (e.g., from 140 kPa to 4020 kPa). Examples of temperatures and pressures suitable for azeotropic formation are provided below. The process of this invention includes embodiments where azeotropic compositions containing from about 10 to 27 mole percent $CCl_3CF_3$ or from about 35 to 56 mole percent $CCl_2FCF_3$ are recovered. HF may be recovered for example, from a product mixture including $CCl_2FCF_3$ formed by the reaction of $CCl_3CF_3$ with HF. In accordance with this invention, an azeotropic composition consisting essentially of HF and unreacted $CCl_3CF_3$ (e.g., 73 to 90 mole percent HF and 27 to 10 mole percent $CCl_3CF_3$) may be recovered and recycled to a reactor for said reaction of $CCl_3CF_3$ and HF. Moreover, processes for producing $CF_3CF_3$ by fluorination of perhalogenated ethanes containing chlorine and fluorine including $CCl_3CF_3$ and $CCl_2FCF_3$ can readily employ azeotropes of HF with $CCl_2FCF_3$ and/or $CCl_3CF_3$.

The distillation equipment and its associated feed lines, effluent lines and associated units should be constructed of materials resistant to hydrogen fluoride, hydrogen chloride and chlorine. Typical materials of construction, well-known to the fluorination art, include stainless steels, in particular of the austenitic type, and the well-known high nickel alloys, such as Monel® nickel-copper alloys, Hastelloy® nickel-based alloys and, Inconel® nickel-chromium alloys. Also suitable for reactor fabrication are such polymeric plastics as polytrifluorochloroethylene and polytetrafluoroethylene, generally used as linings.

The present invention provides compositions which consist essentially of hydrogen fluoride and an effective amount of a compound selected from $CCl_3CF_3$ and $CCl_2FCF_3$ to form an azeotropic combination with hydrogen fluoride. By effective amount is meant an amount which, when combined with HF, results in the formation of an azeotrope or azeotrope-like mixture. As recognized in the art, an azeotrope or an azeotrope-like composition is an admixture of two or more different components which, when in liquid form under given pressure, will boil at a substantially constant temperature, which temperature may be higher or lower than the boiling temperatures of the individual components, and which will provide a vapor composition essentially identical to the liquid composition undergoing boiling.

An azeotrope is a liquid mixture that exhibits a maximum or minimum boiling point relative to the boiling points of surrounding mixture compositions. An azeotrope is homogeneous if only one liquid phase is present. An azeotrope is heterogeneous if more than one liquid phase is present. Regardless, a characteristic of minimum boiling azeotropes is that the bulk liquid composition is then identical to the vapor composition in equilibrium therewith, and distillation is ineffective as a separation technique. For the purpose of this discussion, azeotrope-like composition means a composition which behaves like an azeotrope (i.e., has constant-boiling characteristics or a tendency not to fractionate upon boiling or evaporation). Thus, the composition of the vapor formed during boiling or evaporation of such compositions is the same as or substantially the same as the original liquid composition. Hence, during boiling or evaporation, the liquid composition, if it changes at all, changes only to a minimal or negligible extent. This is to be contrasted with non-azeotrope-like compositions in which during boiling or evaporation, the liquid composition changes to a substantial degree.

Accordingly, the essential features of an azeotrope or an azeotrope-like composition are that at a given pressure, the boiling point of the liquid composition is fixed and that the composition of the vapor above the boiling composition is essentially that of the boiling liquid composition (i.e., no fractionation of the components of the liquid composition takes place). It is also recognized in the art that both the boiling point and the weight percentages of each component of the azeotropic composition may change when the azeotrope or azeotrope-like liquid composition is subjected to boiling at different pressures. Thus an azeotrope or an azeotrope-like composition may be defined in terms of the unique relationship that exists among components or in terms of the compositional ranges of the components or in terms of exact weight percentages of each component of the composition characterized by a fixed boiling point at a specified pressure. It is also recognized in the art that various azeotropic compositions (including their boiling points at particular pressures) may be calculated (see, e.g., W. Schotte, Ind. Eng. Chem. Process Des. Dev. 1980, 19, pp 432–439). Experimental identification of azeotropic compositions involving the same components may be used to confirm the accuracy of such calculations and/or to modify the calculations for azeotropic compositions at the same or other temperatures and pressures.

Compositions may be formed which consist essentially of azeotropic combinations of hydrogen fluoride with a compound selected from $CCl_3CF_3$ and $CCl_2FCF_3$. These include a composition consisting essentially of from about 90 to about 73 mole percent HF and from about 10 to 27 mole percent $CCl_3CF_3$ (which forms an azeotrope boiling at a temperature from between about 20° C. and about 150° C. and a pressure between about 140 kPa and about 4750 kPa); and a composition consisting essentially of from about 65 to about 44 mole percent HF and from about 35 to about 56 mole percent $CCl_2FCF_3$ (which forms an azeotrope boiling at a temperature between about −25° C. and 125° C. and a pressure between about 50 kPa and about 4020 kPa).

At atmospheric pressure, the boiling points of hydrofluoric acid and CFC-114a are about 19.5° C. and 3.0° C., respectively. However, the relative volatility at 276 kPa (40 psia) and 20° C. of HF and CFC-114a was found to be nearly 1.0 as 65 mole percent HF and 35 mole percent CFC-114a was approached. These data indicate that the use of conventional distillation procedures will not result in the separation of a substantially pure compound because of the low value of relative volatility of the compounds.

To determine the relative volatility of HF with each of CFC-114a and CFC-113a, the so-called PTx Method was used. In this procedure, the total absolute pressure in a cell of known volume is measured at a constant temperature for various known binary compositions. Use of the PTx Method is described in greater detail in "Phase Equilibrium in Process Design", Wiley-Interscience Publisher, 1970, written by Harold R. Null, on pages 124 to 126, the entire disclosure of which is hereby incorporated by reference. Samples of the vapor and liquid, or vapor and each of the two liquid phases under those conditions where two liquid phases exist, were obtained and analyzed to verify their respective compositions.

These measurements can be reduced to equilibrium vapor and liquid compositions in the cell by an activity coefficient equation model, such as the Non-Random, Two-Liquid (NRTL) equation, to represent liquid phase non-idealities. Use of an activity coefficient equation, such as the NRTL equation, is described in greater detail in "The Properties of Gases and Liquids", 4th Edition, publisher McGraw Hill, written by Reid, Prausnitz and Poling, on pages 241 to 387; and in "Phase Equilibria in Chemical Engineering", published by Butterworth Publishers, 1985, written by Stanley M. Walas, pages 165 to 244; the entire disclosure of each of the previously identified references are hereby incorporated by reference.

Without wishing to be bound by any theory or explanation, it is believed that the NRTL equation can sufficiently predict whether or not mixtures of HF and any of CFC-114a and CFC-113a behave in an ideal manner, and can sufficiently predict the relative volatilities of the components in such mixtures. Thus, while HF has a good relative volatility compared to CFC-114a at low CFC-114a concentrations, the relative volatility becomes nearly 1.0 as 35 mole percent CFC-114a was approached at 20° C. This would make it impossible to separate CFC-114a from HF by conventional distillation from such a mixture. Where the relative volatility approaches 1.0 defines the system as forming a near-azeotrope. Where the relative volatility is 1.0 defines the system as forming an azeotrope.

It has been found that azeotropes of HF and CFC-114a are formed at a variety of temperatures and pressures. At a pressure of 40 psia (276 kPa) and 20° C., the azeotrope vapor composition was found to be about 65 mole percent HF and about 35 mole percent CFC-114a. This is a heterogeneous azeotrope with the liquid portion being two phases between about 5.7 mole percent HF and about 97.4 mole percent HF. At a pressure of 365 psia (2516 kPa) and 100° C., the azeotrope vapor composition was found to be about 57 mole percent HF and 43 mole percent CFC-114a. This is also a heterogeneous azeotrope with the liquid portion being two phases between about 38.5 and about 88 mole percent HF. Based upon the above findings, it has been calculated that an azeotropic composition of about 65 mole percent HF and about 35 mole percent CFC-114a can be formed at −25° C. and 7 psia (50 kPa) and an azeotropic composition of about 44 mole percent HF and about 56 mole percent CFC-114a can be formed at 125° C. and 583 psia (4020 kPa) Accordingly, the present invention provides an azeotrope or azeotrope-like composition consisting essentially of from about 65 to 44 mole percent HF and from about 35 to 56 mole percent CFC-114a, said composition having a boiling point from about −25° C. at 50 kPa to about 125° C. at 4020 kPa.

It has been found that azeotropes of HF and CFC-113a are formed at a variety of temperatures and pressures. At a pressure of 20.4 psia (about 140 kPa) and 20° C., the azeotrope vapor composition was found to be about 90 mole percent HF and about 10 mole percent CFC-113a. This is a heterogeneous azeotrope with the liquid portion being two phases between about 2.5 mole percent HF and about 99 mole percent HF. At a pressure of 221 psia (1523 kPa) and 100° C., the azeotrope vapor composition was found to be about 81 mole percent HF and about 19 mole percent CFC-113a. This is also a heterogeneous azeotrope with the liquid portion being two phases between about 14 and about 97 mole percent HF. Based upon the above findings, it has been calculated that an azeotropic composition of about 73 mole percent HF and about 27 mole percent CFC-113a can be formed at 150° C. and 688 psia (4750 kPa). Accordingly, the present invention provides an azeotrope or azeotrope-like composition consisting essentially of from about 90 to 73 mole percent HF and from about 10 to 27 mole percent CFC-113a, said composition having a boiling point from 20° C. at about 140 kPa to about 150° C. at about 4750 kPa.

Processes for producing CFC-114a from CFC-113a by catalytic fluorination with HF can result in reactor effluent containing CFC-113a, CFC-114a, and HF. Separation of such effluent can result in production of both CFC-114a/HF and CFC-113a/HF azeotropes. The CFC-113a/HF azeotrope is useful as feed to produce additional CFC-114a. The CFC-114a/HF azeotrope is useful as feed to produce CFC-115 and/or PFC-116. It will also be apparent to one of ordinary skill in the art that distillation including azeotropes with HF can typically be run under more convenient conditions than distillation without HF (e.g., where HF is removed prior to distillation).

What is claimed is:

1. A composition consisting essentially of hydrogen fluoride in combination with an effective amount of $CCl_3CF_3$ to form an azeotrope or azeotrope-like composition with hydrogen fluoride, said composition containing from about 10 to 27 mole percent $CCl_3CF_3$ and from about 90 to 73 mole percent of HF; said composition (i) including a liquid phase and a vapor phase with a composition which is essentially that of said liquid phase, and (ii) having a boiling point which ranges from about 20° C. at 140 kPa when the composition consists essentially of about 90 mole percent HF and about 10 mole percent $CCl_3CF_3$ to about 150° C. at 4750 kPa when the composition consists essentially of about 73 mole percent HF and about 27 mole percent $CCl_3CF_3$.

2. The composition of claim 1 consisting essentially of from about 90 to about 81 mole percent HF and from about 10 to about 19 mole percent 1,1,1-trichlorotrifluoroethane, wherein said composition has a boiling point which ranges from about 20° C. at 140 kPa when the composition consists essentially of about 90 mole percent HF and about 10 mole percent $CCl_3CF_3$ to about 100° C. at 1523 kPa when the composition consists essentially of about 81 mole percent HF and about 19 mole percent $CCl_3CF_3$.

3. The composition of claim 1 consisting essentially of about 73 mole percent HF and 27 mole percent $CCl_3CF_3$ which boils at a temperature of about 150° C. at about 4750 kPa.

4. A process for recovering HF from a product mixture comprising HF and at least one compound having the formula $CF_3CCl_{2+x}F_{1-x}$, where x is 0 or 1, and including $CCl_3CF_3$, comprising:

(1) distilling the product mixture to remove all products which have a lower boiling point than the lowest boiling azeotrope containing HF and $CCl_3CF_3$; and (2) distilling said azeotrope to recover HF as an azeotropic composition of claim 1.

5. The process of claim 4 wherein said azeotropic composition consists essentially of hydrogen fluoride in combination with an effective amount of $CCl_3CF_3$ to form an azeotrope or azeotrope-like composition with hydrogen fluoride, said azeotropic composition containing from about 10 to 19 mole percent $CCl_3CF_3$.

6. The process of claim 4 wherein HF is recovered from a product mixture including $CCl_2FCF_3$ formed by the reaction of $CCl_3CF_3$ with HF; and wherein an azeotropic composition consisting essentially of from about 73 to 90 mole percent HF and about from 27 to 10 mole percent $CCl_3CF_3$, is recovered and recycled to a reactor for said reaction of $CCl_3CF_3$ and HF.

* * * * *